US009509099B2

(12) United States Patent
Di et al.

(10) Patent No.: US 9,509,099 B2
(45) Date of Patent: Nov. 29, 2016

(54) ELECTRICAL CONNECTOR HAVING IMPROVED ANTI-EMI PERFORMANCE

(71) Applicant: FOXCONN INTERCONNECT TECHNOLOGY LIMITED, Grand Cayman (KY)

(72) Inventors: Yong-Song Di, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/605,958

(22) Filed: Jan. 26, 2015

(65) Prior Publication Data

US 2015/0214670 A1 Jul. 30, 2015

(30) Foreign Application Priority Data

Jan. 24, 2014 (CN) ..... 2014 1 0032293

(51) Int. Cl.
*H01R 9/03* (2006.01)
*H01R 13/6581* (2011.01)
*H01R 13/506* (2006.01)

(52) U.S. Cl.
CPC ..... *H01R 13/6581* (2013.01); *H01R 13/506* (2013.01)

(58) Field of Classification Search
CPC ..... H01R 13/6581
USPC ..... 439/607.47, 607.56, 607.58
See application file for complete search history.

(56) References Cited

U.S. PATENT DOCUMENTS 4,641,906 A * 2/1987 Olsson ..... H01R 13/65802 439/465
4,990,103 A * 2/1991 Sazaki ..... H01R 13/5808 439/445
5,108,313 A * 4/1992 Adams ..... H01R 13/514 439/607.47
5,368,505 A * 11/1994 Hoolhorst ..... H01R 9/032 439/470
6,231,374 B1 * 5/2001 Kuo ..... H01R 13/5816 439/455
6,231,392 B1 * 5/2001 van Woensel ..... H01R 13/5808 439/353
6,966,797 B2 * 11/2005 Ko ..... H01R 13/65802 439/607.42
7,485,013 B2 * 2/2009 Kuo ..... H01R 9/03 439/731
7,901,239 B2 * 3/2011 Weber ..... H01R 13/7197 439/455

(Continued)

FOREIGN PATENT DOCUMENTS

WO 2014160785 10/2014
WO WO2014160785 10/2014

*Primary Examiner* — Neil Abrams
(74) *Attorney, Agent, or Firm* — Wei Te Chung; Ming Chieh Chang

(57) ABSTRACT

An electrical connector (100) with an end connected with a cable (200) includes: an insulative housing (10) including a front face (102), a rear face (103), and a number of side faces (101); a number of contacts (20) mounted to the insulative housing; and a metal shell (30) enclosing the insulative housing. The metal shell includes a first metal shell (31), a second metal shell (32), and a third metal shell (3) cooperated to seal gaps between the insulative housing and the cable.

18 Claims, 8 Drawing Sheets

(56) References Cited

U.S. PATENT DOCUMENTS

| | | | | |
|---|---|---|---|---|
| 8,500,489 | B2 | 8/2013 | Lu et al. | |
| 8,794,995 | B2 * | 8/2014 | Wu | H01R 12/598 439/497 |
| 2011/0281464 | A1 * | 11/2011 | Hou | H01R 13/6593 439/607.55 |
| 2011/0281465 | A1 * | 11/2011 | Hou | H01R 13/6581 439/607.55 |
| 2013/0175080 | A1 | 7/2013 | Colahan | |
| 2015/0050837 | A1 * | 2/2015 | Wu | H01R 13/6463 439/607.55 |
| 2015/0214670 | A1 * | 7/2015 | Di | H01R 13/506 439/607.55 |
| 2015/0288107 | A1 * | 10/2015 | Wu | H01R 13/6593 439/357 |
| 2016/0028188 | A1 * | 1/2016 | Dunwoody | H01R 13/6581 439/607.55 |

* cited by examiner

ELECTRICAL CONNECTOR HAVING IMPROVED ANTI-EMI PERFORMANCE

BACKGROUND OF THE INVENTION

1. Field of the Invention

The present invention relates to an electrical connector connected with a cable, and more particularly to an electrical connector having a metal shell.

2. Description of Related Arts

U.S. Pat. No. 8,500,489, issued on Aug. 6, 2013 to Lu et al., discloses an electrical connector connected with a cable. The electrical connector comprises an insulative housing, a plurality of contacts mounted to the insulative housing, and a metal shell enclosing the insulative housing. The metal shell comprises an upper shell and a lower shell mated with the upper shell. Both of the upper and the lower shell comprises a crimping portion for being crimped with the cable. There are gaps formed between the cable and the insulative housing. Therefore, the electrical connector has poor anti-EMI performance.

U.S. Publication No. 2013/0175080, published on Jul. 11, 2013 to Colahan, discloses an electrical connector connected with a cable. The electrical connector comprises a mating portion, a printed circuit board, and a metal shell enclosing the mating portion and the printed circuit board. The metal shell includes a top shell, a bottom mated with the top shell, and a micro crimp. The micro crimp comprises a round portion crimped with the cable and a pair of flat portions bearing against the printed circuit board. The flat portions need be accurately manufactured to fully seal the first and the second shells.

Hence, an improved electrical connector is desired to offer advantages over the related art.

SUMMARY OF THE INVENTION

An object of the present invention is to provide an electrical connector without gaps between the cable and the insulative housing and has good anti-EMI performance.

To achieve the above-mentioned object, an electrical connector with an end connected with a cable comprises: an insulative housing comprising a front face, a rear face, and a plurality of side faces; a plurality of contacts mounted to the insulative housing; and a metal shell enclosing the insulative housing. The metal shell comprises a first metal shell, a second metal shell, and a third metal shell cooperated to seal gaps between the insulative housing and the cable. The first metal shell and the second metal cooperate to enclose the side faces. One of the first and the second metal shells comprises at least one extending portion disposed at a rear portion of the insulative housing, and the third metal shell comprises a circled portion for the cable to extend through and at least one side portion extending from the circled portion, the at least one extending portion and the at least one side portion cooperating to seal some of the gaps formed at a rear of the insulative housing.

According to the present invention, the metal shell comprises a first, second, and third metal shells cooperated with each other to seal gaps between the insulative housing and the cable.

DETAILED DESCRIPTION OF THE PREFERRED EMBODIMENT

Figure 1:
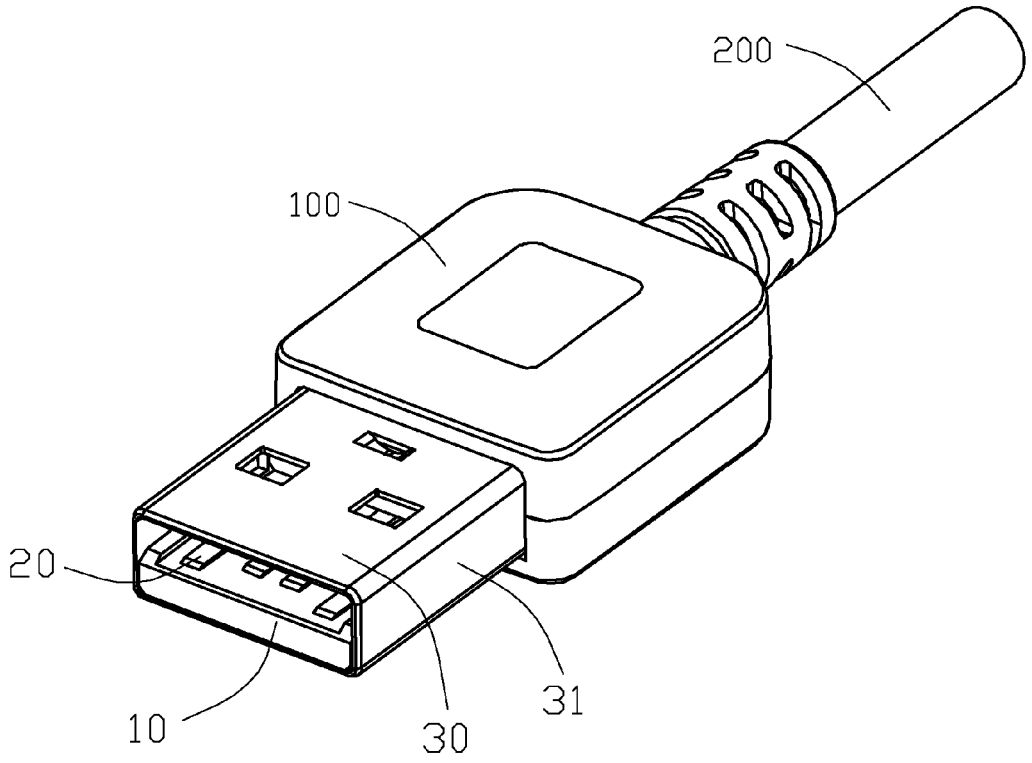
FIG. 1 is a perspective view of an electrical connector connected with a cable in accordance with the present invention.

Reference will now be made in detail to a preferred embodiment of the present invention.

Referring to FIGS. 1 to 6, an electrical connector 100 having an end connected with a cable 200, comprises an insulative housing 10, a plurality of contacts 20 mounted on the insulative housing 10, and a metal shell 30 enclosing the insulative housing 10. The insulative housing 10 comprises a front face 102, a rear face 103 opposite to the front side 102, and a plurality of side faces 101 connected between the front face 102 and the rear face 103. The metal shell 30 comprises a first metal shell 31, a second metal shell 32, and a third metal shell 33 cooperated to seal gaps formed between the insulative housing 10 and the cable 200 and between the metal shell 30 and the cable 200. In this embodiment, the electrical connector 100 is in according with the USB type A 3.1 standard which speed can reach 10 Gbps per channel.

The insulative housing 10 comprises a base portion 11, a tongue portion 12 extending forwardly from the base portion 11, and a supporting portion 13 extending rearwardlly form the base portion 11. The tongue portion 12 is thinner than the base portion 11. The supporting portion 13 is thinner than the base portion 11.

The contacts 20 comprises a plurality of first set contacts 21 for transmitting USB 2.0 signal, and a plurality of second set contacts 22 disposed at a rear portion of the first set contacts 21 for transmitting high speed signal up to 10 Gbps per channel.

The first metal shell 31 comprises a front portion 310 having a closed side face, and a rear portion 311 connected with the front portion having an opened side face. The rear portion comprises a top wall 312, a pair of first side walls 313 extending downwardly from respective side edges of the top wall 312. Each of the first side walls 311 comprises a latch tab 314.

The second metal shell 32 comprises a bottom wall 320, a pair of second side walls 321 extending upwardly from respective side edges of the bottom walls 320, and a pair of extending portions or rear walls 322 extending from respective rear ends of the second side walls 321. The extending portions 322 extend along a direction toward each other and spaced apart from each other. The extending portions 322 also can be designed in the first metal shell 31, or one extending portion 322 designed in the first metal shell 31 while the other extending portion 322 designed in the second metal shell 32. Each of the second side walls 321 defines a latch hole 323 latched with the latch tab 314. Each of the extending portions 322 defines a through hole 324. The second metal shell 32 is mated with the rear portion 311 of the first metal 31 along a top to bottom direction. The first metal shell 31 and the second metal shell 32 are cooperated to enclose the side faces 101 of the insulative housing 10.

The third metal shell 3 comprises a circled portion 330 for the cable 200 being inserted through, and a pair of side portions or side arm portions 331 extending along opposite directions from the circled portion 330. A distance between the two extending portions 322 is greater than or equal to an outer diameter of the circled portion 330. The side portions 331 and the extending portions 322 are cooperated to seal the rear face 103 of the insulative housing 10. The side portions 331 are disposed between the extending portions 322 and the insulative housing 10. The side portions are soldered with the extending portions 322 by the through hole 324. Therefore, the first metal shell 31, the second metal shell 32, and the third metal shell 331 are cooperated to seal gaps between the insulative housing 10 and the cable 200 and between the metal shell 30 and the cable 200.

A linear distance between the front face 102 and the rear end of the circled portion 30 is smaller than or equal to 27.2 mm, which is smaller than a distance substantially equal to 37.8 mm of a traditionary two pieces shell of USB 3.0 A type cable connector.

Figure 2:
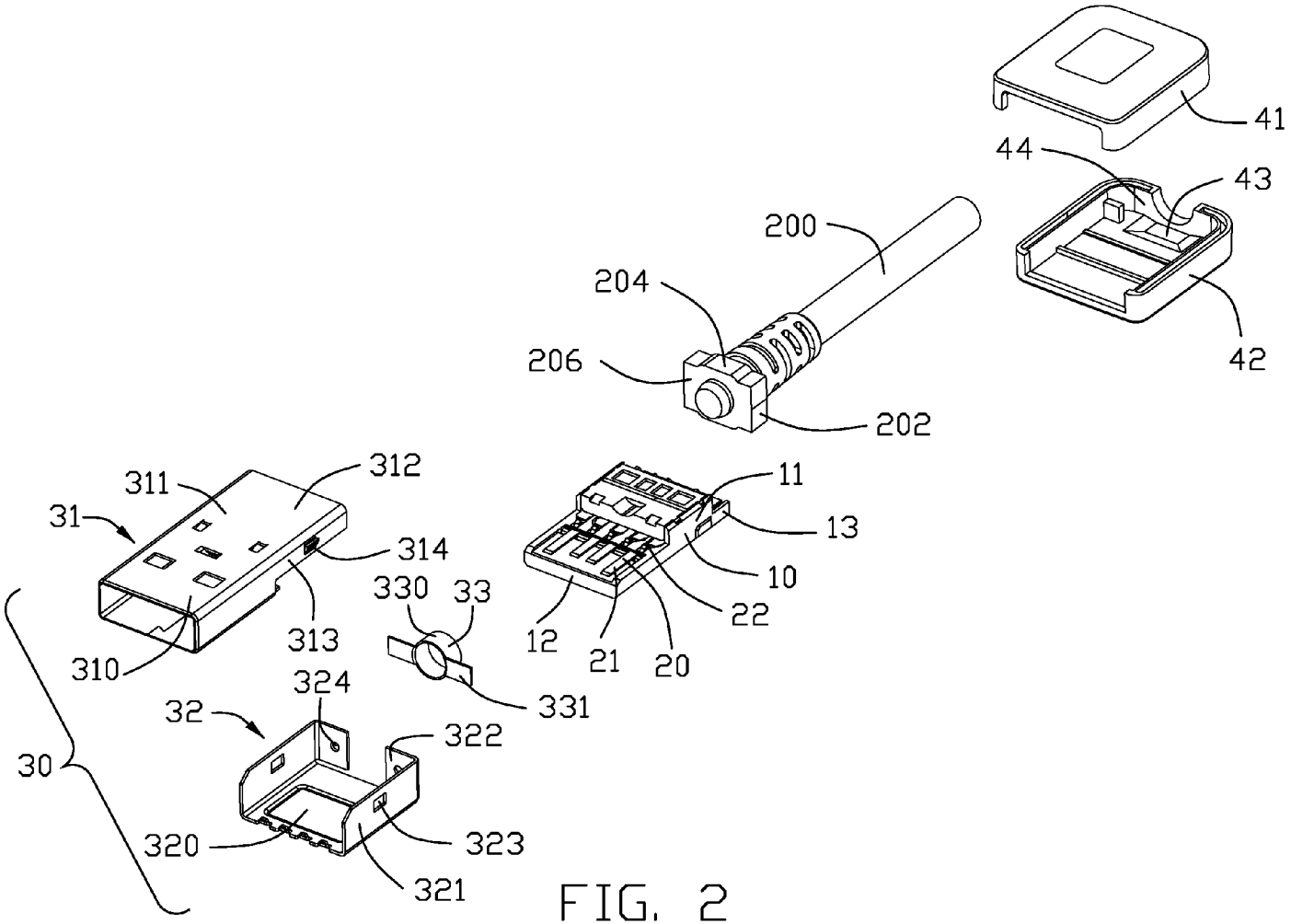
FIG. 2 is an exploded view of the electrical connector and the cable as shown in FIG. 1.
Figure 3:
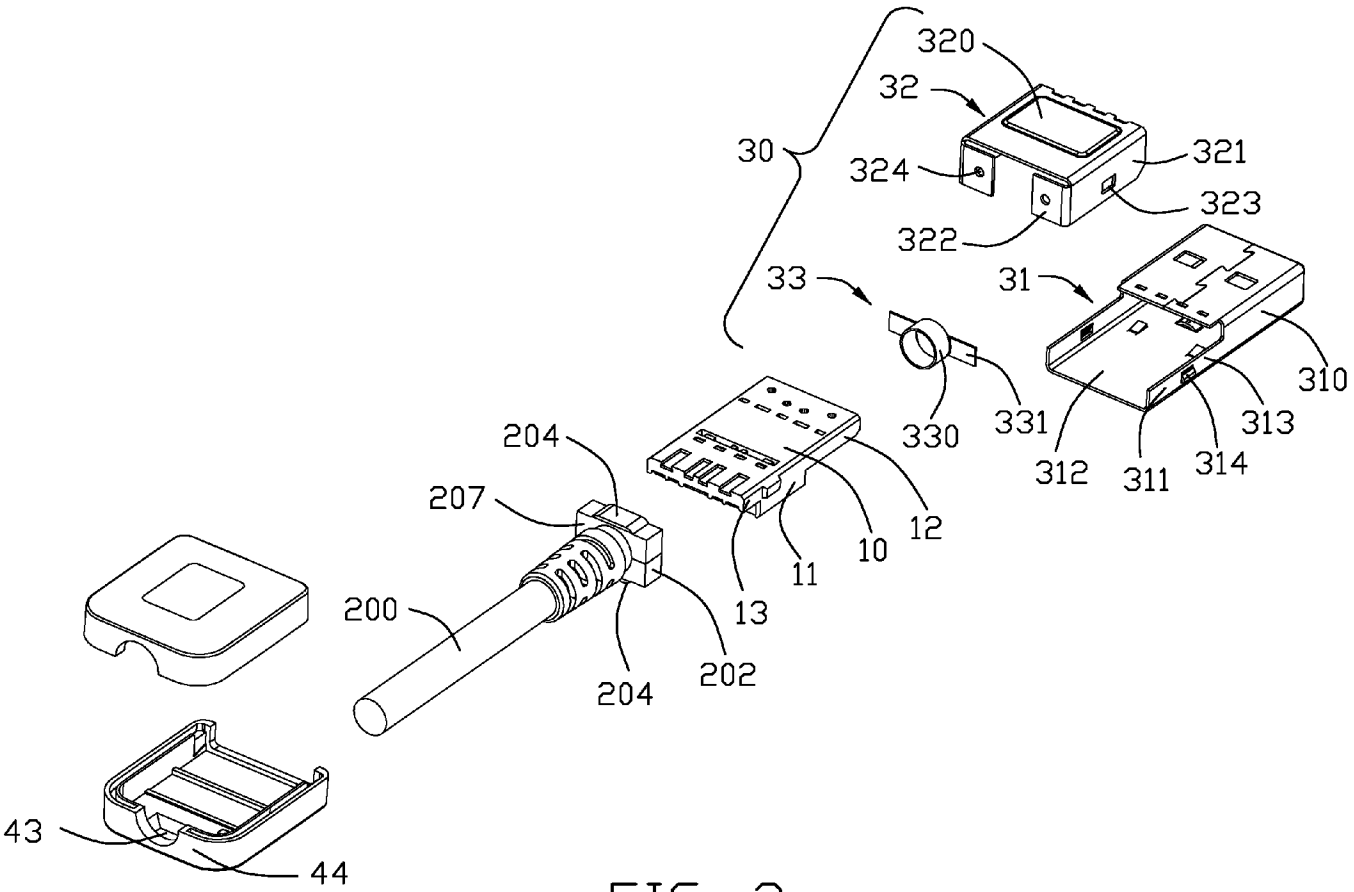
FIG. 3 is another exploded view of the electrical connector and the cable as shown in FIG. 2.
Figure 4:
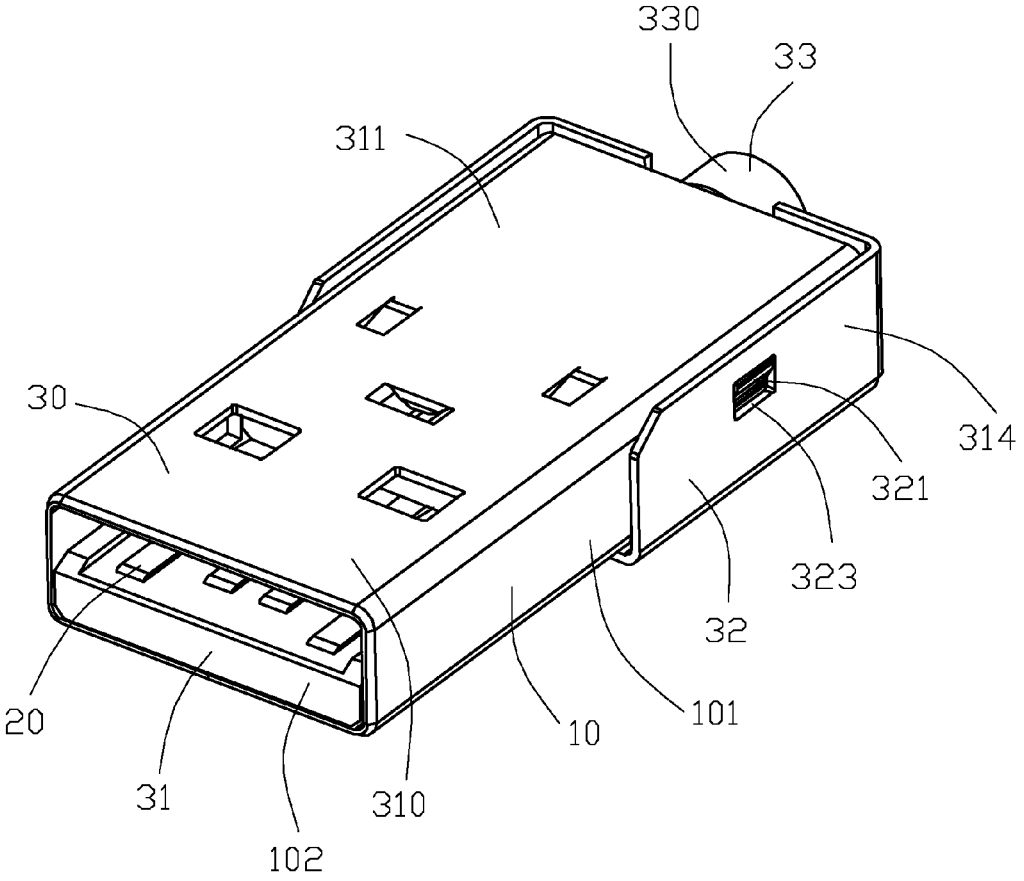
FIG. 4 is a perspective view of the electrical connector as shown in FIG. 1.
Figure 5:
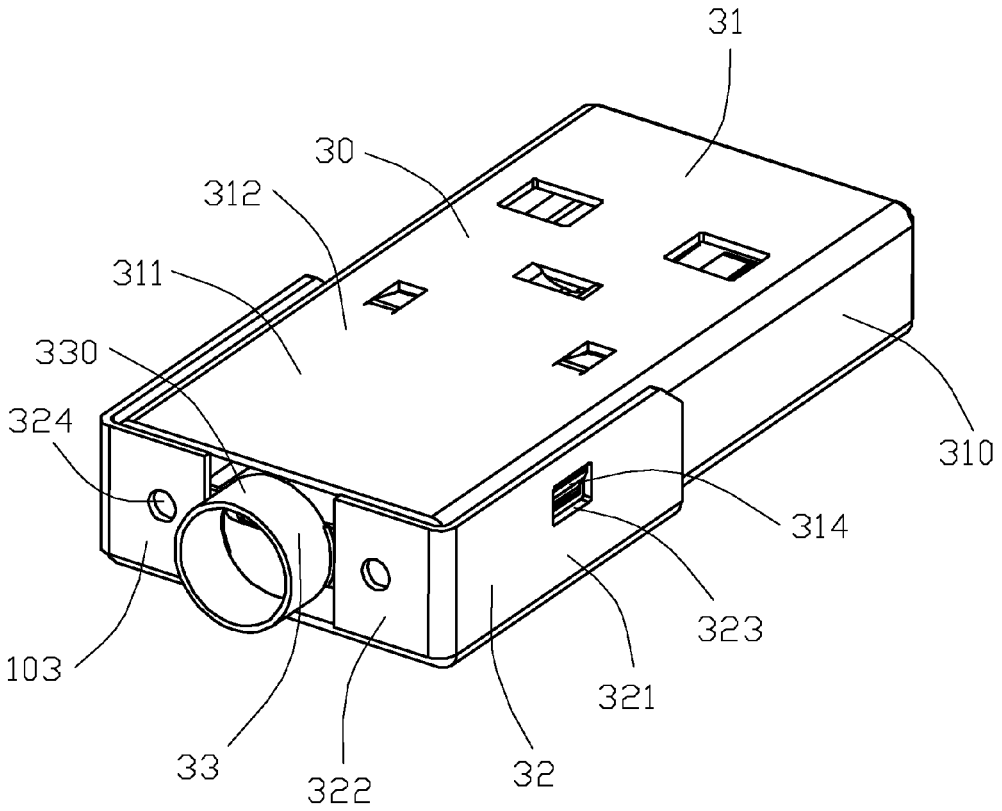
FIG. 5 is another perspective view of the electrical connector as shown in FIG. 4.
Figure 6:
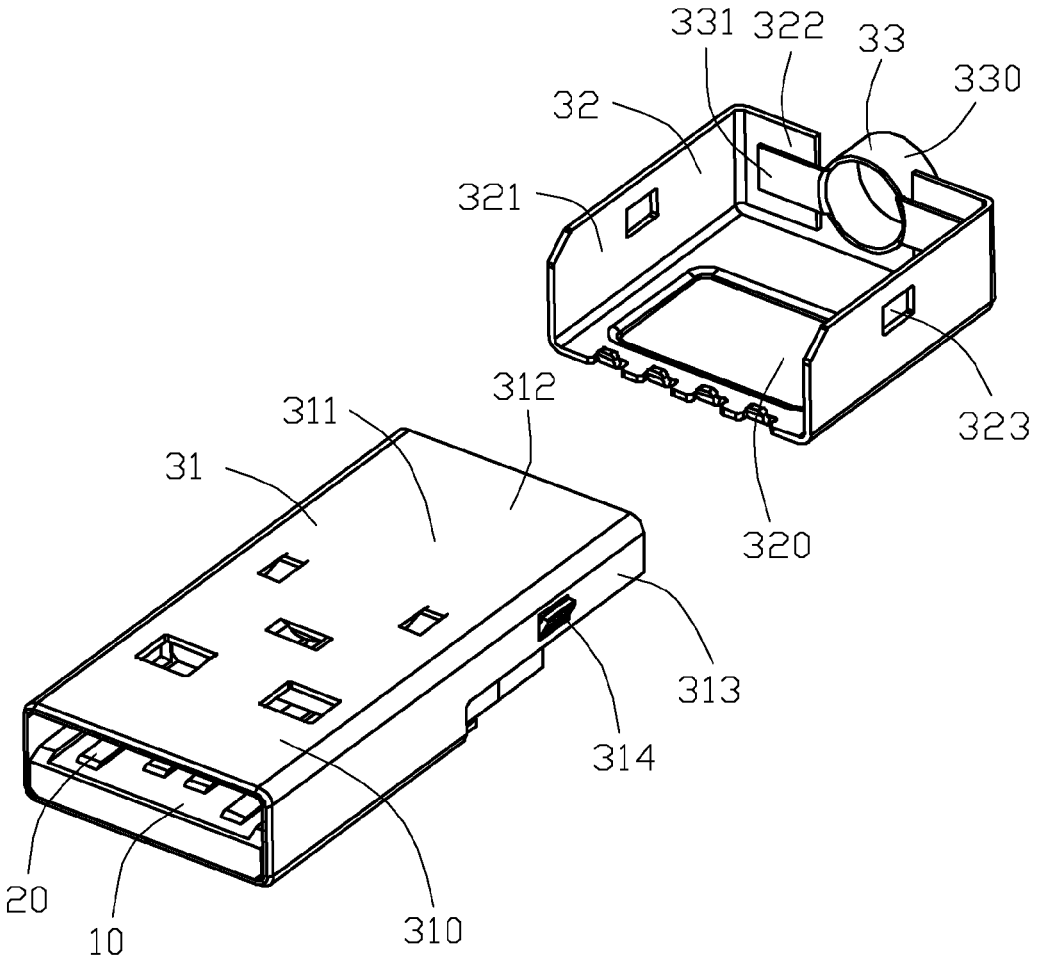
FIG. 6 is a partly exploded view of the electrical connector as shown in FIG. 4.
Figure 7:
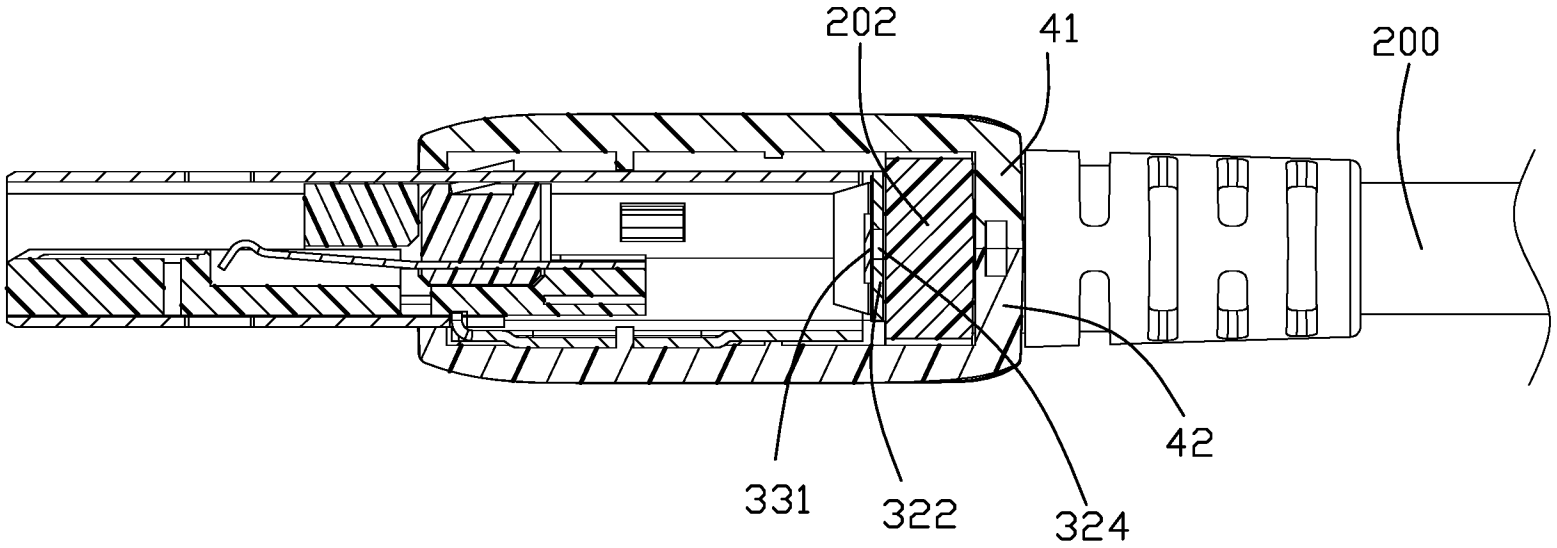
FIG. 7 is a cross-sectional view of the electrical connector and the cable of FIG. 1 along a longitudinal line to show how the side portion of the third metal shell is attached to the extend portion of the second shell via the corresponding through hole and how the strain relief is sandwiched between the cover and the second shell in the front-to-back direction.
Figure 8:
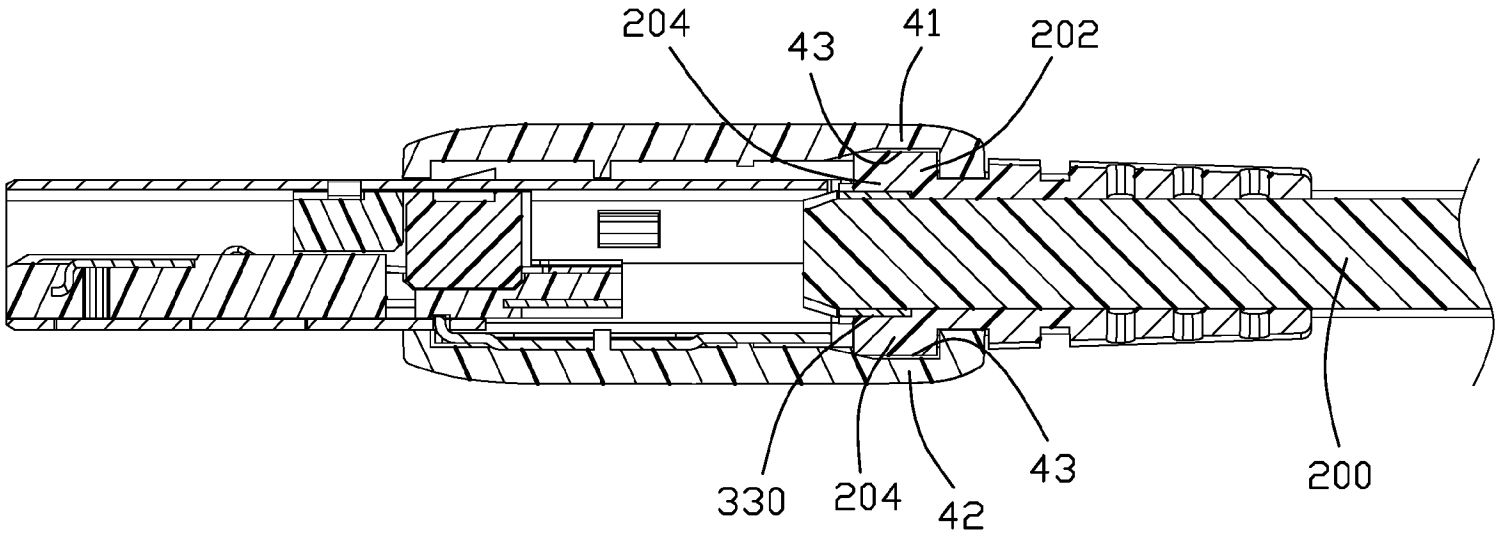
FIG. 8 is a cross-sectional view of the electrical connector and the cable of FIG. 1 along another longitudinal line to show how the protrusion of the strain relief is received in the recess of the cover.

In this embodiment, referring to FIGS. 2, 3 and 8, a pair of covers 41, 42 respectively cover the rear portion 311 of the first metal shell and the second metal shell 32, Each of the covers 41, 42 forms a recess 43. The cable 200 is equipped with a strain relief 202 with a pair of protrusions 204 respectively received within the corresponding recesses 43. Further referring to FIG. 7, the strain relief 202 includes a front confrontation face 206 intimately facing the extending portions 322 and a rear confrontation face 207 intimately facing the rear sides 44 of the covers 41 and 42 so that the strain relief 202 is sandwiched between the rear sides 44 of the covers 41, 42 and the extending portions 322 of the second metal shell 32 in a front-to-back direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector with an end connected with a cable, comprising:

an insulative housing comprising a front face, a rear face, and a plurality of side faces;

a plurality of contacts mounted to the insulative housing; and a metal shell enclosing the insulative housing, the metal shell comprising a first metal shell, a second metal shell, and a third metal shell cooperated to seal gaps between the insulative housing and the cable;

wherein the first metal shell and the second metal cooperate to enclose the side faces;

wherein one of the first and the second metal shells comprises at least one extending portion disposed at a rear portion of the insulative housing, and the third metal shell comprises a circled portion for the cable to extend through and at least one side portion extending from the circled portion, the at least one extending portion and the at least one side portion cooperating to seal some of the gaps formed at a rear of the insulative housing;

wherein the at least one side portion is disposed between the at least one extending portion and the insulative housing;

wherein the at least one extending portion defines a through hole and is soldered with the at least one side portion by way of the through hole.

2. The electrical connector as recited in claim 1, wherein there are two extending portions extending along a direction toward each other and spaced apart from each other.

3. The electrical connector as recited in claim 2, wherein a distance between the two extending portions is greater than or equal to an outer diameter of the circled portion.

4. The electrical connector as recited in claim 2, wherein there are two side portions extending along opposite directions from the circled portion.

5. The electrical connector as recited in claim 1, wherein a linear distance between the front face and the rear end of the circled portion is smaller than or equal to 27.2 mm.

6. The electrical connector as recited in claim 1, wherein the first metal shell is latched with the second metal shell along a top to bottom direction.

7. A cable connector assembly comprising:

an insulative housing equipped with a plurality of contacts extending along a front-to-back direction;

a cable enclosing a plurality of wires, which are connected to the contacts, and rearwardly extending around a rear side of the housing;

a first metallic shell including a front portion surrounding the housing, and a rear portion which is opened one side in a vertical direction perpendicular to said front-to-back direction while cooperating with a second metallic shell to enclose the rear side of the housing, said first metallic shell and said second metallic shell commonly forming a pair of rear walls spaced from each other with a space therebetween in a transverse direction perpendicular to both said front-to-back direction and said vertical direction; and a third metallic shell discrete from said first metallic shell and said second metallic shell and having a cylindrical portion and a pair of side arm portions unitarily formed with each other, said cable extending through the cylindrical portion and secured by said cylindrical portion for securement thereof; wherein the cylindrical portion is snugly received within the space between said pair of rear walls while the pair of side arm portions are secured to the corresponding pair of rear walls, respectively, in the front-to-back direction; wherein each of the rear walls is intimately located behind the corresponding side arm portion, and defines a through hole via which the corresponding side arm portion is soldered to the rear wall.

8. The cable connector assembly as claimed in claim 7, wherein the pair of rear walls lie in a vertical plane perpendicular to said front-to-back direction.

9. The cable connector assembly as claimed in claim 8, wherein an inner edge of each of said pair of rear walls extends in the vertical direction.

10. The cable connector assembly as claimed in claim 7, further including a pair of insulative covers commonly enclosing the rear portion of the first metallic shell and the second metallic portion so as to forwardly cover the through holes along the front-to-back direction.

11. The cable connector assembly as claimed in claim 10, wherein said cable is equipped with a strain relief having a front confrontation intimately facing the rear walls, and a rear confrontation face intimately facing rear sides of the pair of insulative covers.

12. The cable connector assembly as claimed in claim 11, wherein said strain relief includes a pair of protrusions, and the pair of insulative covers include a pair of recesses to receive said pair of protrusions therein, respectively.

13. The cable connector assembly as claimed in claim 7, wherein said pair of rear walls are unitarily formed with the second metallic shell.

14. The cable connector assembly as claimed in claim 13, wherein said pair of rear walls extending from a main body of the second metallic shell toward each other in the transverse direction.

15. A cable connector assembly an insulative housing;

a plurality of contacts disposed in the housing along a front-to-back direction and arranged with one another in a transverse direction perpendicular to said front-to-back direction;

a first metallic shell including a front portion enclosing a front section of the housing, and a rear portion originally opened in one side along a vertical direction, which is perpendicular to both said front-to-back direction and said transverse direction while cooperating with a second metallic shell to enclose a rear portion of the housing;

said first metallic shell cooperating with said second metallic shell to commonly form a pair of rear walls spaced from each other with a space therebetween in the transverse direction;

a third metallic shell discrete from both said first metallic shell and said second metallic shell and including a tubular section and pair of side portions unitarily wherein the tubular section is received within the space and the pair of side portions are intimately located in front of and overlapped with the pair of rear walls in the front-to-back direction, respectively; and a cable enclosing a plurality of wires mechanically and electrically connected to the corresponding contacts, respectively, and extending rearwardly through and secured by the tubular section; wherein each of said rear walls defines a through hole via which the corresponding side portion is soldered to the rear wall.

16. The cable connector assembly as claimed in claim 15, further including a pair of insulative covers commonly enclosing the rear portion of the first metallic shell and the second metallic portion so as to forwardly cover the through holes along the front-to-back direction.

17. The cable connector assembly as claimed in claim 16, wherein said cable is equipped with a strain relief having a front confrontation intimately facing the rear walls, and a rear confrontation face intimately facing rear sides of the pair of insulative covers.

18. The cable connector assembly as claimed in claim 17, wherein said strain relief includes a pair of protrusions, and the pair of insulative covers include a pair of recesses to receive said pair of protrusions therein, respectively.

* * * * *